US010335656B1

(12) United States Patent
Eze

(10) Patent No.: US 10,335,656 B1
(45) Date of Patent: Jul. 2, 2019

(54) GOLF BAG WITH CLUB SPACING FEATURES

(71) Applicant: Olisaemeka Eze, Rohnert Park, CA (US)

(72) Inventor: Olisaemeka Eze, Rohnert Park, CA (US)

( * ) Notice: Subject to any disclaimer, the term of this patent is extended or adjusted under 35 U.S.C. 154(b) by 4 days.

(21) Appl. No.: 15/873,770

(22) Filed: Jan. 17, 2018

Related U.S. Application Data

(60) Provisional application No. 62/447,275, filed on Jan. 17, 2017.

(51) Int. Cl.

| | |
|---|---|
| ***A63B 55/00*** | (2015.01) |
| ***A63B 55/40*** | (2015.01) |
| *A63B 55/57* | (2015.01) |
| *A63B 55/20* | (2015.01) |

(52) U.S. Cl.
CPC ..... *A63B 55/40* (2015.10); *A63B 55/408* (2015.10); *A63B 55/20* (2015.10); *A63B 55/57* (2015.10)

(58) Field of Classification Search
CPC ..... A63B 55/00; A63B 55/008; A63B 55/04; A63B 2055/002; A63B 55/005
USPC ..... 206/315.6, 315.1, 315.3, 315.2
See application file for complete search history.

(56) References Cited

U.S. PATENT DOCUMENTS 2,482,372 A * 9/1949 Rossow ..... A63B 55/10 206/315.2
2,781,072 A * 2/1957 Kouke ..... A63B 55/40 206/315.6
3,534,795 A 10/1970 Wiedenmeier
5,135,107 A * 8/1992 Ingraham ..... A63B 55/40 206/315.6
5,860,520 A 1/1999 Tang
5,944,184 A * 8/1999 Smith ..... A63B 55/40 206/315.6
6,244,437 B1 * 6/2001 Rogers ..... A63B 55/408 206/315.2
6,269,947 B1 * 8/2001 Chang ..... A63B 55/00 206/315.6
6,607,076 B1 8/2003 Smith
9,468,822 B2 10/2016 Mashburn et al.
(Continued)

FOREIGN PATENT DOCUMENTS

| | | |
|---|---|---|
| CN | 106422238 | 2/2017 |
| DE | 10 2015 107 106 | 11/2016 |
| KR | 2001-99113 | 7/2000 |

*Primary Examiner* — Fenn C Mathew
*Assistant Examiner* — Cynthia F Collado
(74) *Attorney, Agent, or Firm* — Stanzione & Associates, PLLC; Patrick Stanzione

(57) ABSTRACT

A golf bag having a body with a pair of flat sides. The body having a separator structure at an upper end that defines a plurality of openings to a plurality of club compartments. The separator structure defines a width between the openings configured to prevent contact between a club head of each club and the shaft of adjacent clubs. In some configurations, each compartment is fully separated from one another. Each club compartment defines a terminal point upon which the club rests within the compartment. The terminal points are configured to offset the club heads of adjacent clubs within the golf bag. In some configurations, a plurality of club receptacles can be provided on one or both of the pair of flat sides.

8 Claims, 10 Drawing Sheets

(56) References Cited

U.S. PATENT DOCUMENTS

| | | | | |
|---|---|---|---|---|
| 2002/0115495 | A1* | 8/2002 | Tan | A63B 55/40<br>473/131 |
| 2013/0098787 | A1* | 4/2013 | Sung | A63B 55/00<br>206/315.2 |
| 2016/0016058 | A1* | 1/2016 | Mashburn | A63B 55/00<br>224/653 |

* cited by examiner

GOLF BAG WITH CLUB SPACING FEATURES

INCORPORATION BY REFERENCE TO ANY PRIORITY APPLICATIONS

Any and all applications for which a foreign or domestic priority claim is identified in the Application Data Sheet as filed with the present application are hereby incorporated by reference in their entireties and made a part of the present disclosure.

BACKGROUND

Field of the Disclosure

The present disclosure generally relates to golf bags and golf clubs and more particularly to a golf bag body and to techniques and structures for improved club dividers and club compartments for efficient organization of the clubs and for eliminating club clanking when the clubs are stored in the bag and are being transported in the bag in a driven cart, push-cart, or carried over the shoulder.

Description of Related Art

The following characteristics and attributes describe a typical golf bag commercially available in the sporting goods stores or sports section of a store. Golf bags are generally tubular in shape. They have two opposite ends. The top end consists of multiple compartments with openings that extend downward toward the bottom of the bag. Golf clubs are inserted into these compartments for storage. Generally, these compartments or stalls are fourteen in number so to correspond with the maximum number of clubs a golfer can carry in his or her bag, which is also fourteen. The top surface is typically not in a horizontal or flat orientation (relative to the sidewall of the bag), having a circular appearance that slants towards the front side of the bag where it tapers off. The body structure of many golf bags also tends to taper in at the neck. The closed bottom end is the base, which constitutes the platform on which the grip ends of the clubs come to rest in the golf bag when the bag is in a standing position. Thus, each compartment is of the same depth. Golf bags typically have four sides: front side, back side, left side and a right side.

The front, the left and the right sides typically have protruding pockets for storing different kinds of articles such as golf balls, tees, gloves, clothing and other personal effects. The two sides when viewed from the back look like flaps or wings. These protruding sides with their numerous pockets give golf bags a typical bulky appearance. The back side is generally straight in its structure. The stands, for supporting the bag when in a tilted position, and the shoulder straps, for carrying the bag, are usually situated in the back side.

These characteristics and the attributes described above pose several usage problems and inconveniences to golfers. These problems and inconveniences are described in the paragraphs below. One or more embodiments of the disclosure may, but do not necessarily, address one or more of the described problems or inconveniences.

1) The dividers, which are generally designed for 14 clubs in the bag, causes the clubs to cluster. This cluster then poses the negative consequence of causing the club heads to make contact and hit each other. The club head of one club can also hit the shaft of the surrounding clubs. In turn, the contact between clubs produces clanking, and damage to the clubs by way of chips and scratches. Clanking is not a desirable noise, and chips and scratches devalue a club. Some golfers elect to invest in club head covers in an effort to overcome this problem.

2) The 14 club compartments are generally not partitioned off all the way to the bottom of the bag. Consequently, this causes the clubs to entangle in the bag. This entanglement in turn makes it difficult for a golfer to retrieve and replace his or her clubs. This experience can be very aggravating—especially when one's round is not going as smoothly as hoped. In particular, when one is already frustrated with a bad shot and attempts to shove a club back in its stall, but the other clubs are in the way due to entanglement.

3) Due to lack of space to conveniently space out the 14 clubs in the bag, typical golf bag top surfaces lack any form of club markers and club identification. This creates the problem of poor club arrangements in the bag and poor orderliness in the club organization in the bag. Once again, the golfer is negatively affected because he or she continually fumbles, trying to figure out from which stall he or she just pulled the club that was just played. In the end, clubs get misplaced from their original positions in the bag. The experience is aggravating and, thus, stressful and energy draining, causing a loss of focus and, consequently, possibly increasing the chances of a poor round of golf.

4) The numerous pockets, just like the unnecessary 14 club silos, mislead golfers into putting all sorts of items and articles in their bags. Many of such items and articles, the golfer never even remembers is in the bag, let alone makes use of. Consequently, not only do these pockets give golf bags a less than fashionable, bulky appearance, but they could also be promoting injury risks that could come from golfers hauling around on his or her shoulders golf bags that weigh one or more pounds too many.

SUMMARY

The systems, methods and devices described herein have innovative aspects, no single one of which is indispensable or solely responsible for their desirable attributes. Without limiting the scope of the claims, some of the advantageous features will now be summarized.

While some of the prior art attempts to address club clanking achieved some success, the clubs in such prior art references are only able to avoid contact, let alone avoid club clanking or club chattering, when the clubs are motionless—that is, secured in a fixed position. By contrast, one or more embodiments of the present disclosure reduces and eliminates club contact and club clanking or chatter while allowing the clubs to move in any direction, including 360 degree swivel, when stored in the bag during transportation, thus maintaining the traditional feel of a golf bag. Moreover, one or more embodiments of the present disclosure also reduces and eliminates clustering of the clubs, which the prior art bags were unable to achieve.

One or more embodiments of the disclosure preferably will achieve one or more (including all) of the following: a) make it easy and fast to access (e.g., retrieval and replacement) the clubs in the bag, b) make it easy to efficiently organize and arrange the clubs in the bag, c) make it easy for a golfer to quickly identify a specific club and to quickly replace it in its original spot in the bag, d) efficiently space out the clubs to prevent them from making contact, thereby eliminate clanking noise and protect the clubs from chips and scratches, e) efficiently space out the clubs to eliminate clustering while at the same time allow a golfer to carry enough clubs in the bag, f) help reduce injury risk and stress through the ease of use the above advantages afford the user of the bag, h) contribute in changing the perception among golfers about how many clubs they carry in their bags, allowing them to carry less clubs in their bags, which means carrying the clubs they actually need and the clubs that work for their game, and i) make the golf bag lighter in weight, less bulky and, therefore, more fashionable. With respect to item h), there are some "standard" clubs in a 14-club bag that are rarely used in many rounds of golf by the average golfer. However, embodiments of the present disclosure are not limited by the provision for less clubs in the bag. One or more embodiments of the present disclosure can still provide all the above advantages while making it possible to carry 14 clubs in the bag simply by increasing the dimension and size of the bag.

One or more embodiments of the present disclosure include one or more of the following features: 1) flat and even (e.g., horizontal) top surface, 2) wide and thick separators, 3) relatively flat sides of the bag body, 4) external wedge storage, 5) multiple terminal point for the clubs inside the bag, and 6) multiple insert bases that define the terminal points.

One or more embodiments of the present disclosure achieves an improved golf bag having some or all of the benefits described herein through some or all of the features described below.

1. PROGRESSIVE RACK TECHNIQUE, PRT™ or PROGRESSIVE RACK TECHNOLOGY, PRT™ with MULTIPLE TERMINAL POINTS™ is the Applicant's marketing terminology that identifies a golf bag incorporating the innovative club compartments with varying depths disclosed herein for arranging and organizing clubs keeps neighboring clubs spaced apart in a height direction and therefore eliminates contact between clubs during 360-degree movement when they are stored in the bag during transportation in the cart or carried over the shoulder. For this reason, in some configurations, the various terminal points are defined by multiple base-inserts providing a resting surface to receive the grip ends of the clubs when the clubs are stored in the bag. In some configurations, the individual silos are also fully compartmentalized and enclosed all around and extending through the terminal surface, thus completely eliminating entanglements between clubs within the bag.

DUAL PURPOSE WIDE SEPARATORS™ or DUAL PURPOSE WIDE RIM SILO™ is the Applicant's marketing terminology that refers to a golf bag Incorporating the innovative spaced-apart club compartments with club identifiers disclosed herein for organizing and arranging clubs. Such an arrangement departs from the norm and widens and thickens the lips or the dividers of the compartments or club silos while narrowing the opening of the club silos. With width measurement of the separators being equal to or greater than the length of the club head the end result ensures, 1) total elimination of contacts between clubs in a 360-degree swivel or side-to-side movements during transportation, and 2) serve as surface for club identification markers which could be in any form, such as a name plate or engraved text.

Flat side bodies refers to the arrangement of some configurations of the present golf bag that eliminates the protruding and flapping side pockets and replaces them with a flat surface or relatively flat surface. OUTSIDE WEDGE™ is the Applicant's marketing terminology that refers to a golf bag incorporating the innovative feature comprising an external storage system exclusively devoted to the wedges (e.g., Lob Wedge, Sand Wedge and Pitching Wedge) which players employ regularly during approach shots and shots made from around the greens. The flat side bodies provide room for the external wedge storage. The outside storage has the purpose of compensating for the lost top space devoted to the widened or thickened divider arrangement described above and further herein. The external wedge storage features result in efficient organization that creates a dedicated storage location for the wedges for faster access, and last but not least, style and fashion. The side bodies therefore can be made of materials strong enough to support the wedges. In some configurations, an inner pocket can be inserted and accessed by way of, for example, a zipper.

One or more embodiments of the present disclosure provides techniques and methods for remedying the shortcomings of the prior art attributes and characteristics mentioned hereinabove. Thus, a golf bag having features, aspects and advantages of one or more embodiments disclosed herein reduces or eliminates clubs from making contact with each other and thereby reduces or eliminates club clanking when the clubs are stored in the bag during transportation.

An embodiment of the present disclosure comprises an elongated, substantially octagonal or top section forming the point of reception of the clubs into the bag. The octagonal shape of the top section of the golf bag can be an integral functional element of one or more embodiments of the present disclosure for achieving one or more benefits of the present disclosure.

In some configurations, the top section includes, for example, 7-11, 8-10 or 9 openings forming the stalls, silos or compartments serving as the club receptacles. In some configurations, an additional compartment may be provided for the putter. Preferably, the openings are smaller in diameter than the ones found in conventional prior art golf bags while still being able to receive standard club shafts, and they are made so to compensate for the size of the separators or dividers. The stalls, silos or compartments are portioned off by separators extending downwards in bag towards the base and, preferably, terminating at the base. The separators or dividers are significantly wider and thicker than those found in prior art golf bags. The thickness and the wide width of the separators prevent the clubs from making contact with each other in whichever direction they swivel or move in the bag during transportation, thus reducing or eliminating clanking noise and also prevent chips and scratches to the clubs caused through the impact of such contact.

The thickness and width of the dividers or separators also provides a surface for including club markers or identifiers for easy identification and for faster access, thus serving a dual function purpose: prevent club contact, and mark and identify clubs. The compartment's rims and the dividers, including the putter well top, preferably are flush in a flat and even structuring. It can be said, therefore, that the top surface of the golf bag of the present embodiment is flat or substantially flat. The octagonal shape of the top surface, the smaller openings of the club compartments, the wide and thick separators, the flush and even surface of the ensemble features separately or in any combination can define integral functional elements of an embodiment of the present disclosure. In some configurations, each of the aforementioned elements are included in the golf bag. Other possible features of the first embodiment and functions thereof will become apparent from the detailed description and drawings below.

In some configurations, the golf club bag provides a club arrangement that appears in an orderly and convenient manner wherein the driver is centrally located for stand-out access, and it stands clear above all the surrounding clubs, where the driver and the surrounding clubs could swivel in a 360-degree turn and not make contact with one another. There are thus three storage compartment sections (see, for example, FIG. 4), one on the right, the middle and the left, running in parallel line from the front of the bag to the back. The golf bag is not limited to such a configuration and it is only used as one of several arrangements capable of providing for club arrangements. For instance, the clubs can be arranged in a Right Slant (RS) formation wherein the Long clubs (e.g., the driver, 2-iron and 3-wood for instance) are stored on the right, the mid clubs (e.g., 5-iron, 6-iron and 7-iron) in the middle, and finally the short clubs (e.g., 8-iron, 9-iron) are stored on the left, creating a slant flow from right to left. A Left Slant (LS) arrangement would be the opposite.

In some configurations, at least one of and, preferably, the two sides of the bag are flat. Preferably, the sides are made of a relatively sturdy material, which can be any material of cloth or fiber (which can be reinforced) apparent to those skilled in the art. The flat surfaces of one or both sides can be used for storage or one or more clubs, such as for the wedges (e.g. Pitching wedge, Sand wedge, Lob wedge). This external storage feature can compensate for the top surface space used to accommodate the wide club opening separators and thus achieve the beneficial goal of eliminating club contact and reducing or eliminating club clanking. The flat surface sides address shortcomings of the prior art, which include multiple protruding pockets that create bulkiness, weight, made storing the prior art bags into any space cumbersome, and gave them a poor fashion appearance. One or more embodiments of the present disclosure remedies these shortcomings and provides for better use of the golf bag side body by way of the exterior wedge storage.

In some configurations, the wedge housing includes three receptacles, which, for example, can be in the form of pouches running in three parallel vertical lines. In some configurations, the receptacles are of equal length. The pouches or receptacles can be made of, for example, sturdy luxury leather for fashion appeal. In some configurations, a hook attached to the body of the bag to receive the club head and hold it in a fixed position so that the club head does not move (e.g., rotate) during transportation. A nameplate or marker can be affixed to the body of pouch and bearing the identification of a particular wedge for easy and fast access. The identification names can also be embroidered on the pouch as opposed to on a nameplate affixed to the pouch.

In some configurations, the golf club bag provides a storage technique, which can be marketed under the term PROGRESSIVE RACK TECHNIQUE™, which ensures that the club heads of all three wedges maintain the same height when they are stored in the bag, even when they are actually of different sizes in length. This is made possible by creating varying terminal points for each wedge in their individual pouches. The different terminal points can be made by way of sewing or other suitable arrangements apparent to those skilled in the art.

In an alternative arrangement, the wedge pouches can be configured in an alternate arrangement in which the upper ends of the pouches are located at varying heights. In such a configuration, the wedge heads have varying heights and so do their terminal points, which in this case is defined by the actual base of their individual pouches. The storage arrangement starts with the Lob wedge and progresses downwards to the Pitching wedge.

In some configurations, an alternative receptacle of the wedge housing is a cavity as opposed to pouch. The cavity has a depth sufficient to receive a portion or an entirety of the designated club. In some configurations, the depth can be about half to one inch deep into the body of the bag wherein the wedge is inserted into the cavity and rests snuggly. That is, the cavity can extend inwardly from the exterior surface of the side of the golf bag. Alternatively, the cavity can be formed by a structure that is attached to or extends outward from the side surface of the golf bag. Thus, the cavity can be an inward or internal cavity or an external cavity relative to the side surface of the golf bag. Preferably, a cavity is provided for each wedge (or other club) desired to be stored on the side of the bag. The progressive arrangement of the cavities, and thus the wedges, can stay the same as the pouch described above.

In some configurations, a pocket is inserted into the flat sides, accessible for example by way of a zipper. However, preferably, the pocket is configured in such manner that should minimize or prevent any kind of protrusion of the side of the golf bag.

In some configurations, the external wedge storage has a definite functional purpose that is an integral part of the top section configuration. In particular, the top section with the flat top surface, along with the wide separators and other features as described above are made possible, are made more practical or benefit from the external wedge storage.

In some configurations, the front of the bag is slightly flat with inserted pockets to avoid or minimize any protrusion. The bottom end can be tapered in to accommodate storage on a motorized cart. In some configurations, the back of the bag runs in a straight line from top to bottom. In other words, the back of the bag is flat or substantially flat. The stands and the strap for carrying the bag are located in the back.

In some configurations, multiple base inserts conforming to the inner shape of the bag are used to provide varying resting platforms for each club stored in the bag. Each base insert has a hole or holes to let a club through to a lower base insert. The grip end of the clubs come to rest on one of the inserts when they are stored in the bag. The grip end of any particular club may pass through one of the holes in one or more of the base inserts. In some configurations, the base inserts when installed in the bag run from on the front side to the backside, thus providing a sturdy structural support to the bag.

In some configurations, a golf bag includes a golf bag body having a front wall, a rear wall and a pair of side walls. At least the pair of side walls is substantially flat. The golf bag body has an interior space. A top surface of the golf bag body is flat and perpendicular to the front, rear and pair of side walls. A plurality of separators is located at an upper end of the golf bag body and defines a plurality of openings to respective ones of a plurality of club compartments. Each of the separators has a width configured to prevent contact between each club head and shafts of adjacent clubs. A plurality of terminal surfaces is each associated with one of the plurality of compartments and defines a bottom end of the compartment. The plurality of terminal surfaces is configured to create an offset in height of each club head and adjacent club heads.

In some configurations, the golf bag also includes a plurality of club receptacles on one or both of the pair of side walls.

In some configurations, each of the club receptacles is one of a cavity extending into the body of the golf bag, a cavity raised relative to an outer surface of the golf bag and a pocket attached to the outer surface of the golf bag.

In some configurations, the club compartments are fully separated from one another.

In some configurations, a golf bag for reducing or eliminating contact between golf clubs within the golf bag includes a golf bag body having an elongate octagonal shape in a top view. The golf bag body comprises a flat top surface, a pair of flat sides and defines an interior space. A plurality of club openings are defined by the top surface, each configured to receive a designated golf club. The golf bag includes a plurality of terminal structures. Each of the plurality of club openings is associated with one of the plurality of terminal structures such that the golf bag defines a club storage depth for each of the plurality of club openings. The club storage depth for a particular one of the plurality of club openings is a linear distance between the particular club opening and the associated terminal structure. A plurality of external club receptacles are provided on one or both of the pair of flat sides and located external of the interior space of the golf bag body. The golf bag includes a plurality of different club storage depths, the club storage depths configured such that for each club opening a club head of the designated club positioned in the club opening is positioned at a different height than and is spaced-apart in a height direction from the club heads of designated clubs positioned in neighboring club openings. A separation between the plurality of club openings is configured such that contact is prevented between the club heads of clubs having relatively lower club head heights and the club shafts of neighboring clubs having relatively higher club head heights.

In some configurations, one or more inner pockets are provided within the flat sides of the golf body.

In some configurations, a strap is attached to a rear side of the golf bag body for carrying the bag.

In some configurations, two utility compartments are located adjacent a front side of the golf bag on opposing sides of the golf bag.

In some configurations, a putter well is located adjacent a front side of the golf bag, the putter well having a raised collar configured to limit rotational movement of a head of a putter positioned within the putter well.

In some configurations, a plurality of club identification markers are provided, each associated with a respective one of the plurality of club receptacles and club openings.

In some configurations, a plurality of retention elements are provided, each associated with a respective one of the plurality of club receptacles and configured to limit or prevent movement of a club head of the club received within the club receptacle.

In some configurations, each of the club receptacles is one of a cavity extending into the body of the golf bag, a cavity raised relative to an outer surface of the golf bag and a pocket attached to the outer surface of the golf bag.

In some configurations, a golf bag includes a golf bag body having a front wall, a rear wall and a pair of side walls. At least one of the pair of side walls is substantially flat. The golf bag body has an interior space. A top surface of the golf bag body is flat and perpendicular to the front, rear and pair of side walls. A plurality of club receptacles is located on the at least one substantially flat side wall configured for storage of an associated plurality of clubs outside of the interior space of the golf bag body. A plurality of separators is located at least at an upper end of the golf bag body and defines a plurality of openings to respective ones of a plurality of club compartments. A plurality of terminal surfaces are provided, each of the plurality of terminal surfaces associated with a different one of the plurality of compartments and defining a bottom end of the compartment. The plurality of terminal surfaces is configured to provide the plurality of club compartments with varying depths. A combination of a width of each of the separators and an offset in a height of the plurality of terminal surfaces is selected to prevent contact between a club head of a club received in each of the plurality of club compartments and a club head or a club shaft of clubs received in adjacent club compartments by spacing the clubs sufficiently apart from one another and staggering a height of the club head of each club relative to the club heads of adjacent clubs.

In some configurations, a plurality of club identification markers are provided, each associated with a respective one of the plurality of club receptacles and compartments and configured to associate a particular club with a particular one of the plurality of club receptacles and compartments.

In some configurations, a putter well is located adjacent the front wall of the golf bag, the putter well having a raised collar configured to limit rotational movement of a club head of a putter positioned within the putter well.

In some configurations, a pair of utility compartments is located adjacent the front wall of the of the golf bag, with each one of the pair of utility compartments located on opposing sides of the putter well.

In some configurations, each of the club receptacles is a cavity that extends either inwardly from or outwardly from an outer surface of the body of the golf bag.

In some configurations, each of the club receptacles is a pocket attached to an outer surface of the golf bag.

In some configurations, the plurality of club receptacles comprises three receptacles configured to receive three wedge clubs.

In some configurations, a plurality of retention elements is provided, each associated with a respective one of the plurality of club receptacles and configured to limit or prevent movement of a club head of the club received within the club receptacle.

In some configurations, one or more inner pockets are provided within and are accessible from the exterior of one or more of the front wall, the rear wall and the pair of side walls.

In some configurations, a strap is attached along the rear wall for carrying the golf bag.

The foregoing is a summary and thus may contain simplifications, generalizations, inclusions, and/or omissions of detail. Consequently, those skilled in the art will appreciate that the summary is illustrative only and is not intended to be in any way limiting. In addition to the illustrative aspects, embodiments, and the features described hereinabove, further aspects, embodiments, and features will become apparent by reference to the drawings and the following detailed description.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through the use of the accompanying drawings.

DETAILED DESCRIPTION

Figure 1:
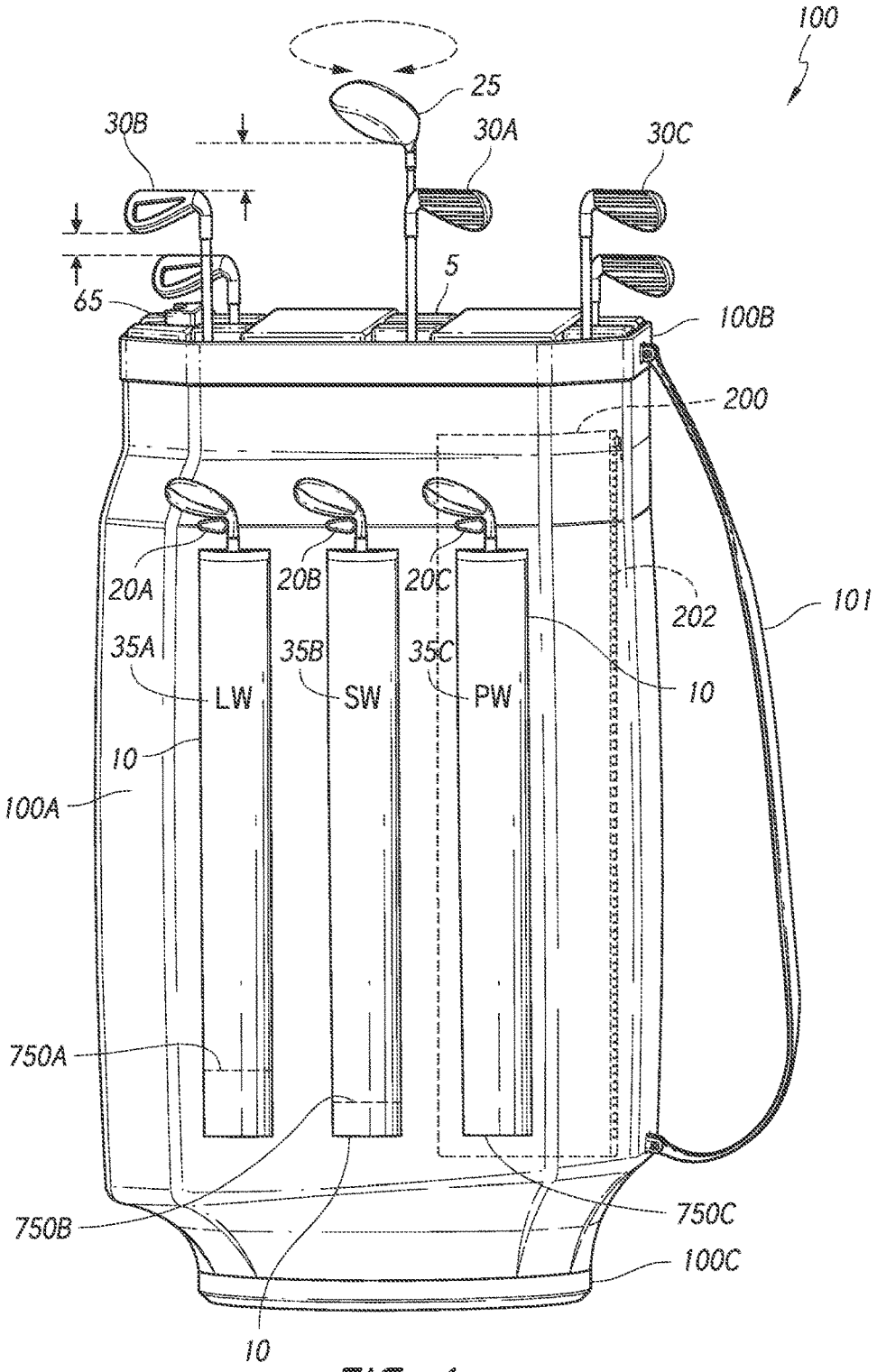
FIG. 1 is a side view of a golf bag having certain features of the present disclosure, including an external club (wedge) storage feature.

Embodiments of systems, components and methods of assembly and manufacture will now be described with reference to the accompanying figures, wherein like numerals refer to like or similar elements throughout. Although several embodiments, examples and illustrations are disclosed below, it will be understood by those of ordinary skill in the art that the inventions described herein extends beyond the specifically disclosed embodiments, examples and illustrations, and can include other uses of the inventions and obvious modifications and equivalents thereof. The terminology used in the description presented herein is not intended to be interpreted in any limited or restrictive manner simply because it is being used in conjunction with a detailed description of certain specific embodiments of the inventions. In addition, embodiments of the inventions can comprise several novel features and no single feature is solely responsible for its desirable attributes or is essential to practicing the inventions herein described.

Certain terminology may be used in the following description for the purpose of reference only, and thus are not intended to be limiting. For example, terms such as "above" and "below" refer to directions in the drawings to which reference is made. Terms such as "front," "back," "left," "right," "rear," and "side" describe the orientation and/or location of portions of the components or elements within a consistent but arbitrary frame of reference which is made clear by reference to the text and the associated drawings describing the components or elements under discussion. Moreover, terms such as "first," "second," "third," and so on may be used to describe separate components. Such terminology may include the words specifically mentioned above, derivatives thereof, and words of similar import.

A portion or all of the golf club bag embodiments disclosed herein keep golf clubs stored in the bag clear of each other and thus reduce or eliminate club clanking during transportation. The embodiments disclosed also provide efficient arrangement of the clubs in the bag and thus reduce or eliminate cluster, make club storage, identification and access very easy and fast. These and other benefits described in detail in the following description are achieved, in at least some embodiments, by one or more (including all) specific, multiple core features or elements described herein. These features include 1) multiple terminal base inserts or multiple terminal points or locations for the clubs stored in the golf bag, 2) dividers wider and thicker than prior art size and that effectively separates the clubs and prevents contact between clubs in any direction the clubs may move in their individual compartments during transportation, and also serve as mounting surface for nameplates or tags or engraved symbols identifying each club and their position in the golf bag of invention, 3) a specific storage area for the wedges, which preferably is external of the main interior chamber of the golf bag, to allow a player to carry sufficient golf clubs in the golf bag while at the same time reducing or eliminating clusters, preventing club contacts while stored in the bag and being transported, and thus remedying the shortcomings of prior art that does the opposite, 4) flat sides of the golf bag body, which not only makes the external club storage possible or practical, but also reduces or eliminates protruding pockets to provide for a lighter golf bag and a more fashionable golf bag. The flat sides incorporate an internal pocket accessed by way of zipper to maintain the flat configuration of golf bag side body.

FIG. 1 is a side view of a golf bag 100 incorporating the top section, the wide separators and a offset club head technique keeping the clubs apart and thus preventing them from making contact to with each other to avoid clanking noise according to an embodiment of the disclosure. The flat side incorporating the exterior wedge housing is also shown.

In the illustrated arrangement, the golf bag 100 incorporates a preferred embodiment of a top section 100B, which has a flush and even surface bearing multiple compartments through which clubs 25, 30A-30C are received in the golf bag 100. Preferably, the upper surface of the top section 100B is horizontal or substantially horizontal when the golf bag 100 is sitting upright on a level surface. In other words, the upper surface of the top section 100B preferably is perpendicular to the sides and/or longitudinal axis of the golf bag 100. The top surface of the golf bag 100 can be parallel to the bottom surface of the base 100C of the golf bag 100. The illustrated golf bag 100 also incorporates multiple wide separators or dividers 5. Also incorporated in the flush surface of top section 100B is the putter well located in the front section of the bag, which can include a raised collar 65 to hold the putter head in place in a fixed or limited rotational position about an axis of the putter shaft.

In some configurations, the golf bag 100 includes a flat side body 100A incorporating the external club (wedge) housing units 10. Preferably, the flat side body 100A is planar or substantially planar along a significant portion of the side body 100A, which can contain or include the portion occupied by the wedge housing units 10. The side body 100A is not necessarily exactly planar, but has a substantially flat shape in contrast to the curved sidewall of a typical cylindrical golf bag. Such an arrangement provides more internal space for club storage to the golf bag 100 and provides an advantageous location for the wedge housing units 10. As described above, the flat side body 100A can incorporate an internal pocket 200 accessed by way of zipper 202 to maintain the flat configuration of golf bag side body 100A.

The base 100C is shown, for supporting golf bag frame when in standing position as is known in the art. The base 100C can define the lower or bottom surface of the golf bag 100. A shoulder strap 101 for carrying the bag is also shown.

The illustrated configuration of the top section 100B surface coupled with the club arrangement is such that the driver 25, which is one of the most used clubs in the bag, is centered in the middle and stands well clear above all the clubs next to it. Other clubs of different sizes 30A-30C are stored in the individual compartments and are shown clearly apart from each other and not making contact. The heads of clubs 30C and 30D, for instance, stand clear of those of the taller clubs next to them. Each club in the golf bag 100 extends inside the bag 100 down to its allocated terminal base (FIG. 8) where their grips—the opposite end of golf club—come to rest in the bag 100. These varying terminal points achieved by the multiple individual base inserts or termination locations help produce the club arrangement and separation as shown in the top section 100B of the golf bag 100. Thus, in any which direction the clubs move, shift position or swivel while stored in the bag, the dual function wide separators 5 in conjunction with the multiple terminal points keeping the heads clear of each other, the clubs will not make contact with each other and thereby reduce or eliminate clanking.

In prior art golf bags, there are generally fourteen (14) compartments designed with the intention for players to carry fourteen (14) golf clubs in the bag. To accommodate so many clubs in the small top surface of prior art bags, space is by obvious logic sacrificed. Consequently, prior art bags create cluster which causes clubs to bang into each other when stored in the bag, causing unpleasant noise and damage to the clubs. In a presently preferred embodiment as illustrated in FIG. 1, at least some of the prior art shortcomings are overcome or addressed by utilizing a flat body side 100A of the golf bag 100 to install exterior storage for the wedges, thus compensating for the spaces sacrificed in the top section 100B to accommodate the wide separators. By so doing, the golf bag 100 of FIG. 1 thus allows a player to still carry sufficient number of clubs in his or her bag while, at the same time, avoiding cluster, club chatter and the resulting club damage. The exterior wedge storage as shown in FIG. 1 includes, for example, three pockets 10 spaced out and arranged on the same plane. The pockets 10 can be made of any durable material, such as leather or textile, as deemed appropriate to those skilled in the art. As discussed herein, other suitable receptacles for the external clubs can also be used, such as snap-fit or other types of recesses.

The wedges, e.g., Lob (lofted or L-Wedge) 15A, Sand 15B and Pitching 15C, are inserted into their individual pockets 10. Although the clubs vary in actual length, they appear to have the same height when stored in their individual pockets as shown. In other words, the club heads are located at the same height along a longitudinal axis of the golf bag 100. This is achieved by varying the depth of the pockets 10, which in this embodiment is accomplished by providing terminal points 750*a*, 750*b* (in phantom) and 750*c* for each pocket 10 at different locations along a longitudinal axis of the golf bag 100. In the illustrated arrangement, the terminal points 750*a-c* are created by stitching, molding or another suitable arrangement. In some configurations, the terminal points 750 are located within an interior of the pockets 10 and constructed in a way to avoid any visible outline of the club's shaft and grip on the outside wall of the pocket, such as using a stiff material that does not deform to a significant extent or providing a sufficient amount of space within the pocket 10. A plurality of retention arrangements, such as clips or hooks 20A-20C (or other suitable arrangements), is affixed to the body of the bag 100 to hold the club heads in place and prevent them from moving around during transportation. For example, the retention arrangements 20A-20C can be configured to hold the club heads against or close to the outer surface of the side body 100A. In some configurations, each pocket 10 can measure about 2-5 inches, about 3-4 inches, about 3.5 inches or 3.4 inches wide. Such a measurement can correspond to or can be greater than the normal length of a wedge club head. In some configurations, each pocket 10 or receptacle has an open top into which the club can be inserted into the pocket/receptacle and stored. The width helps to keep the three wedge heads apart when stored in their individual pockets. The pockets can be separated by, for example, about 2-3 inches at the club head end. The pockets can be spaced below an upper end of the bag by about 3-5 inches, about 4-5 inches or about 4.5 inches.

For easy identification, access and ensuring that the wedges are returned to their original pockets after use, identifiers, such as name tags 35A-35C, are affixed to the pockets 10 as shown. The name plates or tags 35A-35C can be made of any material such as leather, plastic or cloth. The identification marks 35A-35C can also be embroidered onto the surface of the pockets 10.

Figure 2:
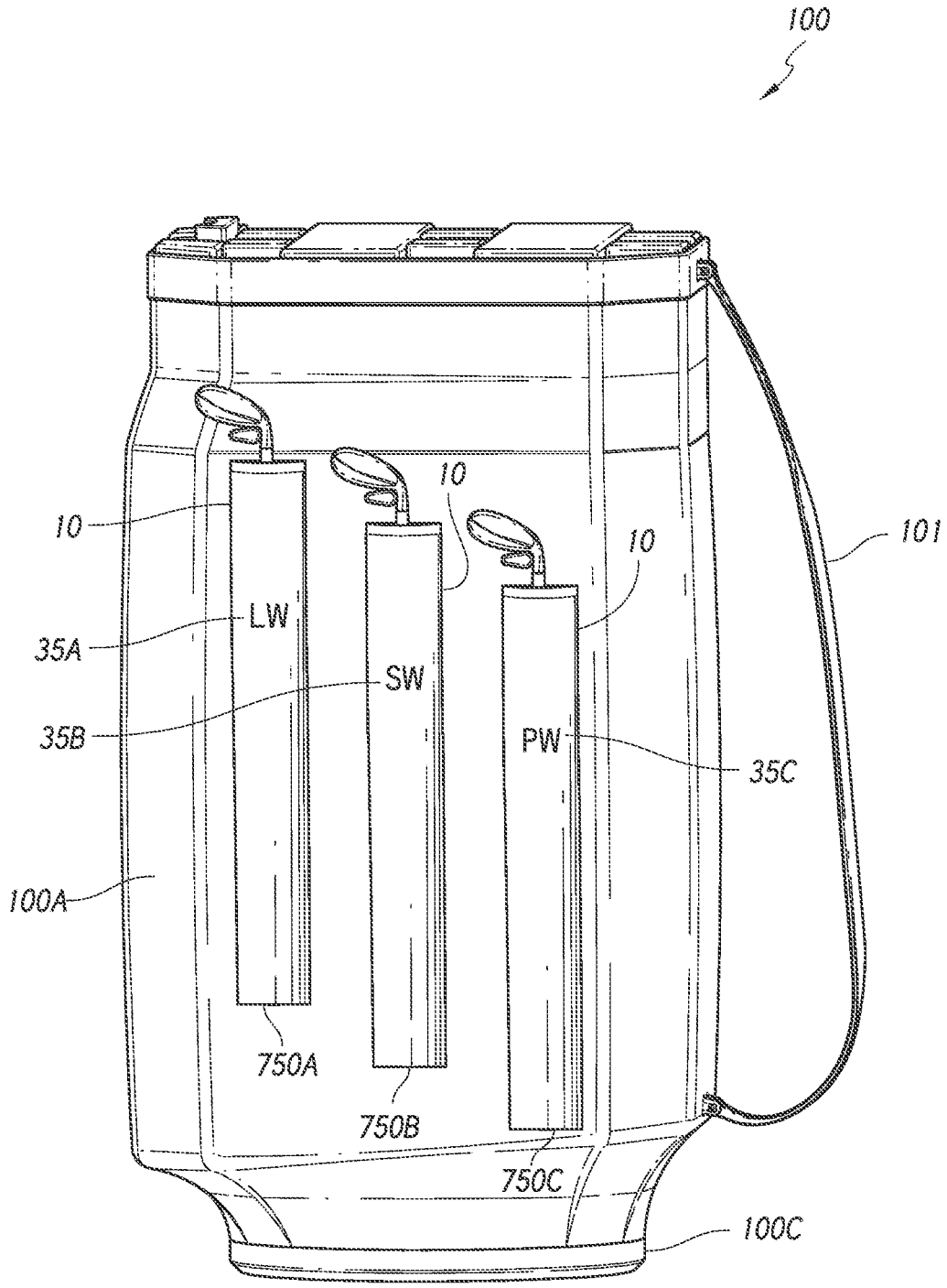
FIG. 2 is a side view of a golf bag similar to the golf bag of FIG. 1, but having an alternative external club (wedge) storage feature.

FIG. 2 is a view of a golf bag 100 having an alternate configuration of the exterior wedge housing depicted in FIG. 1. In this embodiment, the wedge pouches or pockets 10 are arranged for style, with different heights for each wedge in the bag, and grips coming to rest at the bottom of each assigned pocket 10. Progressive rack techniques of varying terminal points for the wedges are achieved solely by the arrangement of the pockets 10.

In the illustrated arrangement, the pockets 10 are positioned in diagonal progression across the flat side body 100A of the golf bag 100. In this arrangement, the varying terminal points 750A, 750B, 750C for the wedges correspond to the length of each pocket 10. In other words, the bottom ends of the pockets 10 define the terminal points 750A, 750B, 750C and the bottom ends of the pockets 10 can be offset relative to the longitudinal axis of the golf bag 100. This arrangement gives the bag a fashionable and appealing look. It is apparent that the exterior wedge housing can be arranged in several ways without diminishing their functionality, which in at least some configurations is to free storage spaces in the top section or internal space of the bag 100 to accommodate the dual function wide dividers, thus reducing or eliminating cluster, preventing clubs from making contact and thus banish clanking and reducing club damage, in addition to one or more of the other benefits as disclosed hereinabove.

Figure 3:
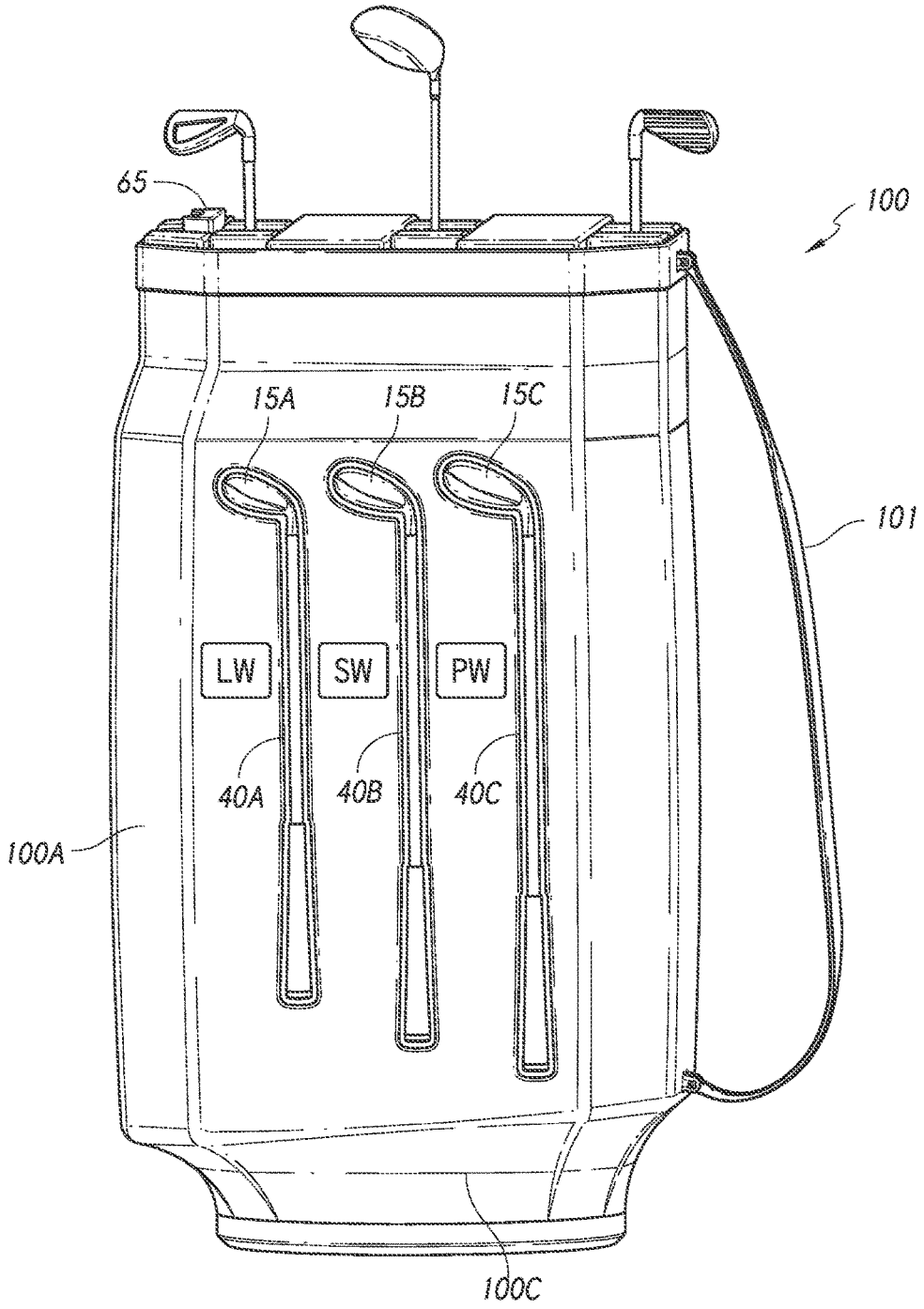
FIG. 3 is a side view of a golf bag similar to the golf bags of FIGS. 1 and 2, but having yet another alternative external club (wedge) storage feature.

FIG. 3 illustrates a golf bag 100 having another alternative configuration and structuring of the exterior wedge housing shown in FIG. 1. In this configuration, the exterior wedge housing comprises a cavity in which each of the wedges is inserted to hold them in place.

In the arrangement of FIG. 3, instead of pockets 10 as shown in FIGS. 1 and 2, the external club (wedge) housing structure comprises cavities 40A-40C that extend into the wall of the flat side 100A of the bag 100 and in which the shafts and the heads of the wedges 15A-15C are received in storage. The wedges 15A-15C fit in (e.g., snap in) and rest snuggly within the cavities 40A-40C. Such an arrangement can eliminate the need for a hooks 20A or other retention arrangements to hold the club heads in place (to inhibit or prevent rotation) as cavities 40A-40C are designed in such a way to easily receive and hold in the clubs during transportation (e.g., a snap-fit arrangement), and designed with access portions or to otherwise easily yield to allow club retrieval from the cavities 40A-40C. The grip ends of the clubs can come to rest at the bottom of the cavities 40A-40C for added support and to hold the clubs in place. The top end of the cavities can be open or closed depending on, for example, whether club access or club security is prioritized.

Desired appearance can also determine some or all of the shape or features of the cavities 40A-40C. In the embodiment shown in FIG. 3, the cavities 40A-40C are close-ended and, as such, a convenient gap can be provided between the toe of a wedge stored in the cavity 40A-40C and the lip of the cavity 40A-40C. A golfer using the golf bag 100 would simply insert one or a few fingers in the gap to very easily retrieve the wedge. When installed in a raised configuration (extending outward from the side 100A of the bag 100—not shown), the cavities 40A-40C can have closed bottom but open-ended top. In this configuration, the cavities 40A-40C can be configured such that the toes of the wedges can extend outward from the cavity 40A-40C for a sufficient distance (e.g., about an inch or two) to allow a golfer using the golf bag 100 to easily grab the wedge of his or her choice by the toe and effortlessly remove it from the cavity 40A-40C.

Figure 4:
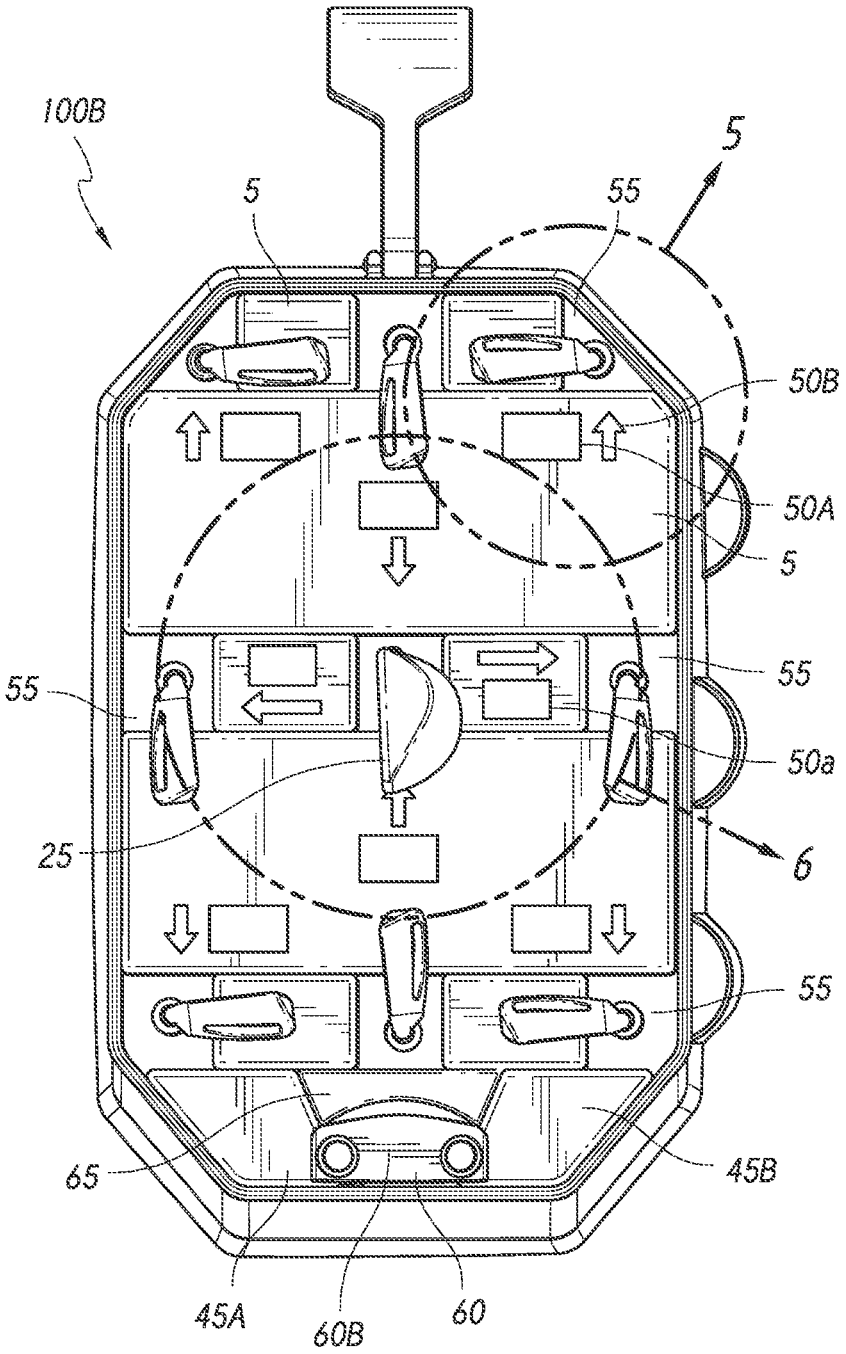
FIG. 4 is a top view of the golf bag of FIG. 1.
Figure 5:
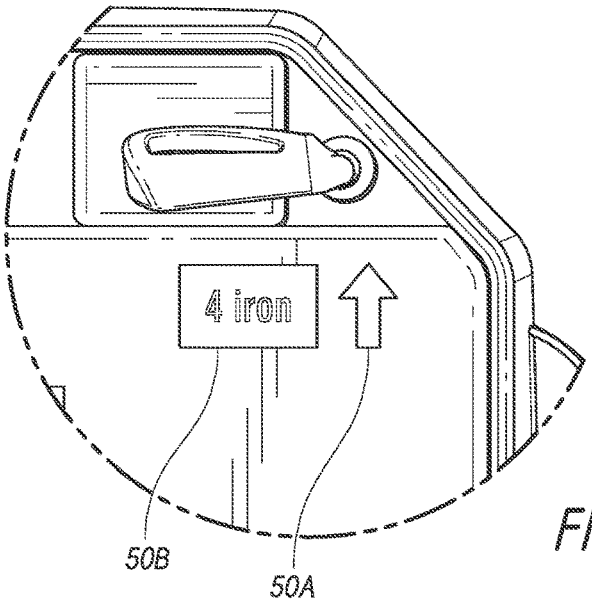
FIG. 5 is an enlarged view of a portion of the top of the golf bag in FIG. 4.
Figure 6:
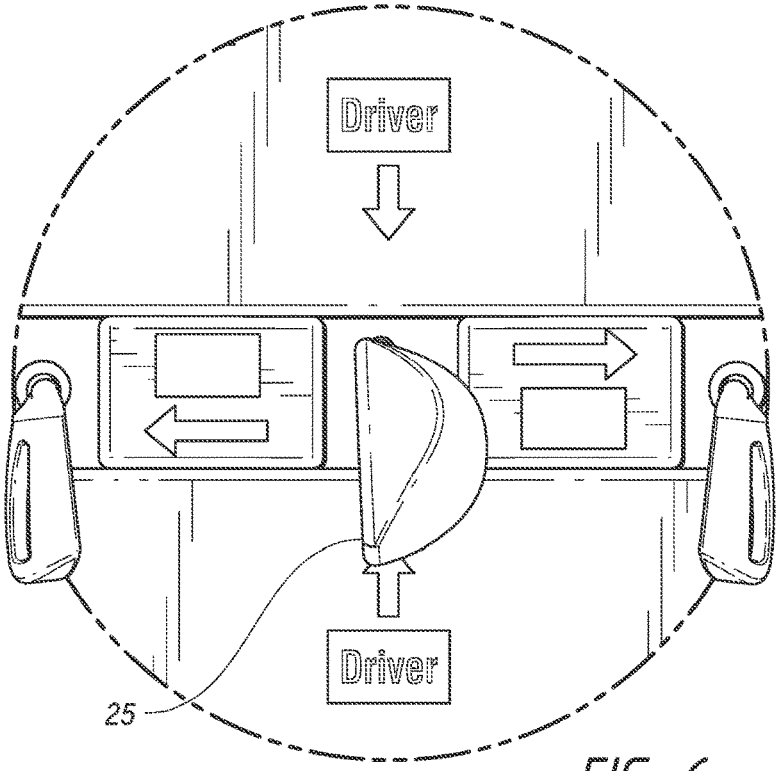
FIG. 6 is an enlarged view of another portion of the top of the golf bag in FIG. 4.

FIGS. 4-6 are plan views of the top of the golf club bag 100 shown in FIG. 1. FIGS. 4-6 illustrate the top section 100B, which comprises multiple compartments, each configured to receive a designated golf club. FIGS. 4-6 also illustrate the wide separators and the offset heights of the clubs, which prevent the clubs from making contact and thus reduces or eliminates clanking noise. In the illustrated arrangement, the driver is centrally position in the golf bag. Club identification tags or markers can be installed on the surface of the dual function wide separators and next to the club being identified. In the illustrated configuration, the putter well is flanked by two provisional utility spaces. FIGS. 5 and 6 are enlarged views of the dual function wide separators performing their dual role of separating the clubs in the bag as well as serving as a mounting surface for the club identification tags or nameplate.

As described, FIG. 4 illustrates a plan view of the entire top section 100B of the golf bag 100 illustrating different components including, for example, wide separators 5, multiple receptacles or compartments 55 in which golf clubs 25, 70 are inserted for storage, club identification markers 50A and 50B, putter well 60 with a raised collar 65 for holding the putter 60B in place and from making contact with surrounding clubs when it is stored in the bag 100, and provisional utility spaces 45A and 45B. As described above, preferably, the entire surface of the octagonal shaped top section of the illustrated golf bag 100 is flush and flat. That is, the top surface 100B of the golf bag 100 lies in a single plane or substantially lies in a single plane perpendicular to a longitudinal axis of the bag 100 or parallel with the bottom surface. However, in other arrangements, only portions of the top surface 100B lie in a single plane, such as the outer periphery. Other portions can be raised or lowered relative to the outer periphery (or other planar portion of the top surface 100B). In some configurations, a depth (front to back dimension) of the top section 100B is between about 11 inches and about 17.5 inches and a width (side to side dimension) of the top section is between about 9.5 inches and about 12.5 inches.

In the illustrated arrangement, the storage compartments are grouped in three vertical (relative to the orientation in FIG. 4) columns or sections—left, middle and right—running from the front of the golf bag 100 to the back. The front of the golf bag 100 is at the bottom and the back of the golf bag 100 is at the top in FIG. 4. The driver 25 in the configuration and arrangement shown in the drawing is centered in the middle for quick and convenient access. The driver 25 generally is the second most used club after the putter 60B. It is pertinent, however, to emphasize that the configuration and arrangement in the illustrated embodiment is by no means limiting. The illustrated bag 100 has a top surface that depicts a total of nine clubs stored in the bag 100 and spaced out and not clustered and, therefore, avoiding clanking. This is made possible by the wide separators 5, which serve as barriers to the clubs each time they move in any direction when resting in the various compartments 55 during transportation. In the illustrated arrangement, each of the left, middle and right sections includes three openings or compartments 55 configured to receive a designated club. The openings or compartments 55 can be substantially aligned in rows from left to right or from one side to the other of the golf bag body.

In the illustrated configuration, the terminal point of the center compartment 55 is relatively higher than the compartments 55 on each side, above and below the center compartment 55. Thus, the center compartment 55 has a shorter height or club storage depth than the heights or storage depths of the compartments 55 on each side, above and below the center compartment 55. Similarly, each corner compartment 55 has a relatively higher terminal point—or a shorter height or club storage depth—than the side compartments 55 between the corner compartments 55. The heights of the terminal points or the club storage depths can vary between the "relatively higher" compartments 55 and the "relatively lower" compartments 55. That is, the "relatively higher" compartments 55 can have different heights or depths from one another and/or the "relatively lower" compartments 55 can have different heights or depths from one another—as discussed with reference to FIGS. 8 and 13. The terminal points or club storage depths can be selected in view of the lengths of the designated clubs for each compartment 55 to ensure vertical offset of neighboring club heads to avoid contact between neighboring club heads.

The wide separators 5 also serve as a mounting surface for the club identification markers 50A and 50B. The two enlarged partial views 103, 104 of FIGS. 5 and 6 further illustrate the role of the wide separators 5 in the illustrated embodiment. In the top enlarged partial view 103 of FIG. 5, the club 70 in the bag 100 is clearly identified as a 4 iron by the tag 50A, with the arrow 50B pointing towards the 4 iron. Similarly, in the second enlarged partial view 104 of FIG. 6, the club 25 centrally located in the bag 100 is clearly identified as the driver 25 by the two markers, wherein the nameplate of tag 50A spells out the word driver, while the arrow 50B points to the driver 25.

When resting in the putter well 60, the head of the putter 60B can sometimes tilt either to the left or to the right when it is caused to move in the bag 100 during transportation. Therefore, the purpose of the collar 65 is to allow it to do so without interfering or making contact with the surrounding clubs. The collar 65 can limit rotational movement of the putter head, such as by defining end points of a range of motion. Finally, the two provisional utility spaces 45A and 45B, which may have a top lid or be left open, are for storing such convenient equipment as ball retrievers and umbrellas.

Figure 7:
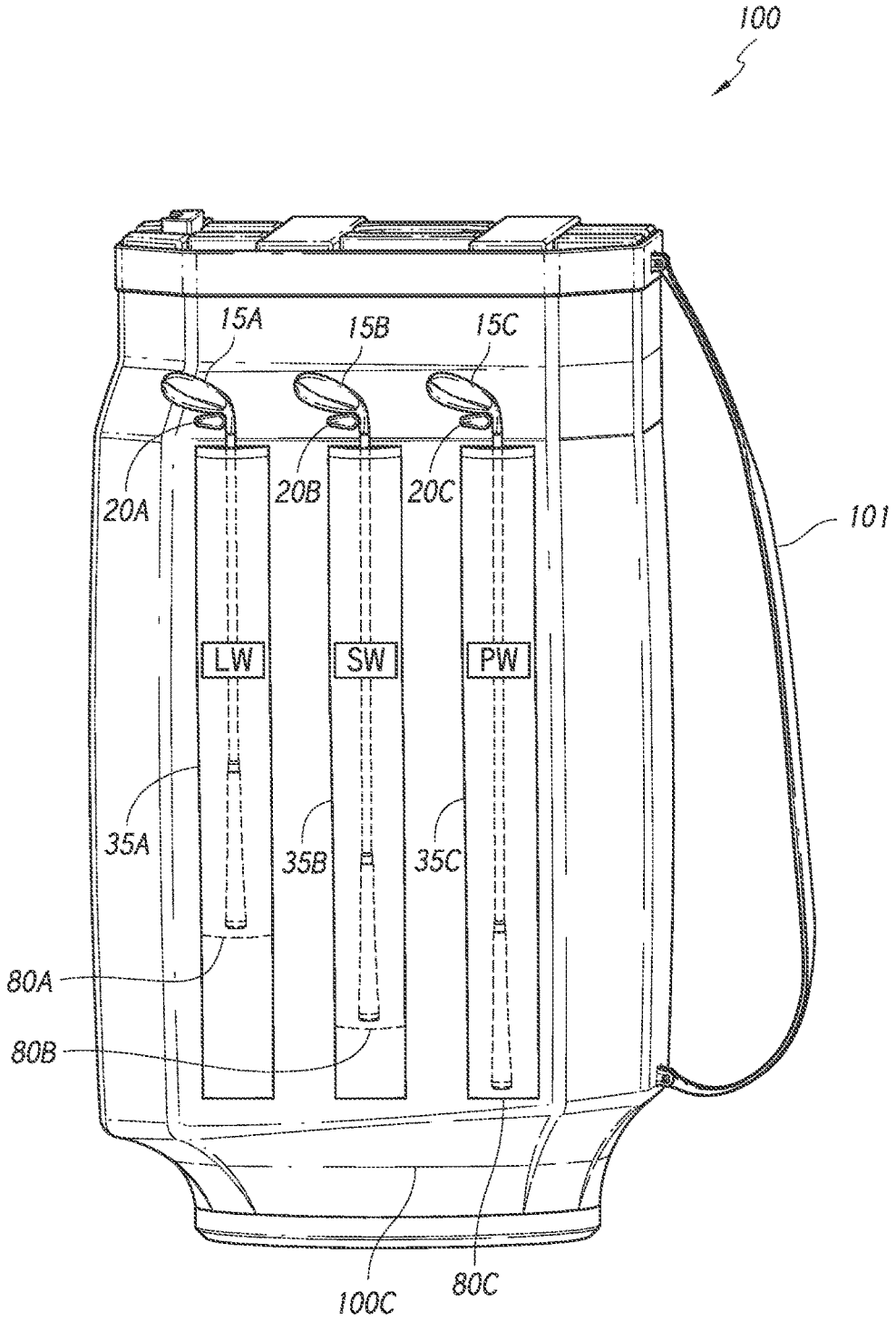
FIG. 7 is a side view of the golf bag of FIG. 1 with the wedges stored within the external club storage feature illustrated in dashed line.

FIG. 7 is a side view of a golf bag 100 showing the exterior wedge housing pockets or pouches 35A-35C. This view shows the progressive rack technique employed to produce uniform height for the club heads of the wedges despite their size (length) differences. In this embodiment, the terminal point of one or more of the pouches 35A-35C is an internal stitching work, not an insert. However, any suitable arrangement can be used. Also shown in this view are retention elements or hooks that keep the wedge heads from moving around (e.g., away from the side of the golf bag) during transportation.

In FIG. 7, one configuration of the external wedge housing is illustrated with certain internal structures illustrated in dashed lines to show the wedges 15A-15C as they are stored in their individual pockets 35A-35C. The illustrated housing comprises three separate pockets 35A-35C affixed to the flat side 100A of the bag 100 and arranged in parallel, a few inches or so apart and of equal external size. The top ends are open for receiving the wedges 15A-15C while the bottom ends are closed or sealed. However, preferably, each wedge 15A-15C rests on a different terminal point 80A-80C in its designated pocket 35A-35C. The Lob Wedge 15A comes to rest at a point 80A a first distance (e.g., a few inches) from the bottom of its assigned pocket 35A. The Sand Wedge 15B rests at lower terminal point 80B a second distance from the bottom of the pocket 35B, which is less than the first distance. In the illustrated arrangement, the Pitching Wedge 15C rests at the bottom of its assigned pocket 35C. In other words, the bottom of the pocket 35C can define the terminal point 80C. The terminal points 80A and 80B for the Lob and Sand Wedges 15A and 15B, respectively, may be defined by a stitch work, but such an arrangement is not limiting. Any suitable arrangement for defining the terminal points 80A-80C can be used. The terminal points 80A-80C can be configured such that the heads of the clubs 15A-15C are located at approximately the same height relative to a vertical or longitudinal axis of the golf bag 100. Thus, the terminal points 80A-80C can take into account the various lengths (or differences in length) of the clubs 15A-15C and can be located accordingly.

Located at the top of each storage pocket are retention arrangements, such as clips or hooks 20A-20C, affixed to the body of the bag 100. The retention arrangements help keep the heads of the wedges 15A-15C in place and restrain, inhibit or prevent them from moving around (e.g., rotating or moving away from the body of the bag 100) during transportation in a cart or when carried over the shoulder. The retention arrangements 20A-20C can substantially prevent movement or can simply limit the range of motion of the club heads to within a satisfactory range of motion.

Figure 8:
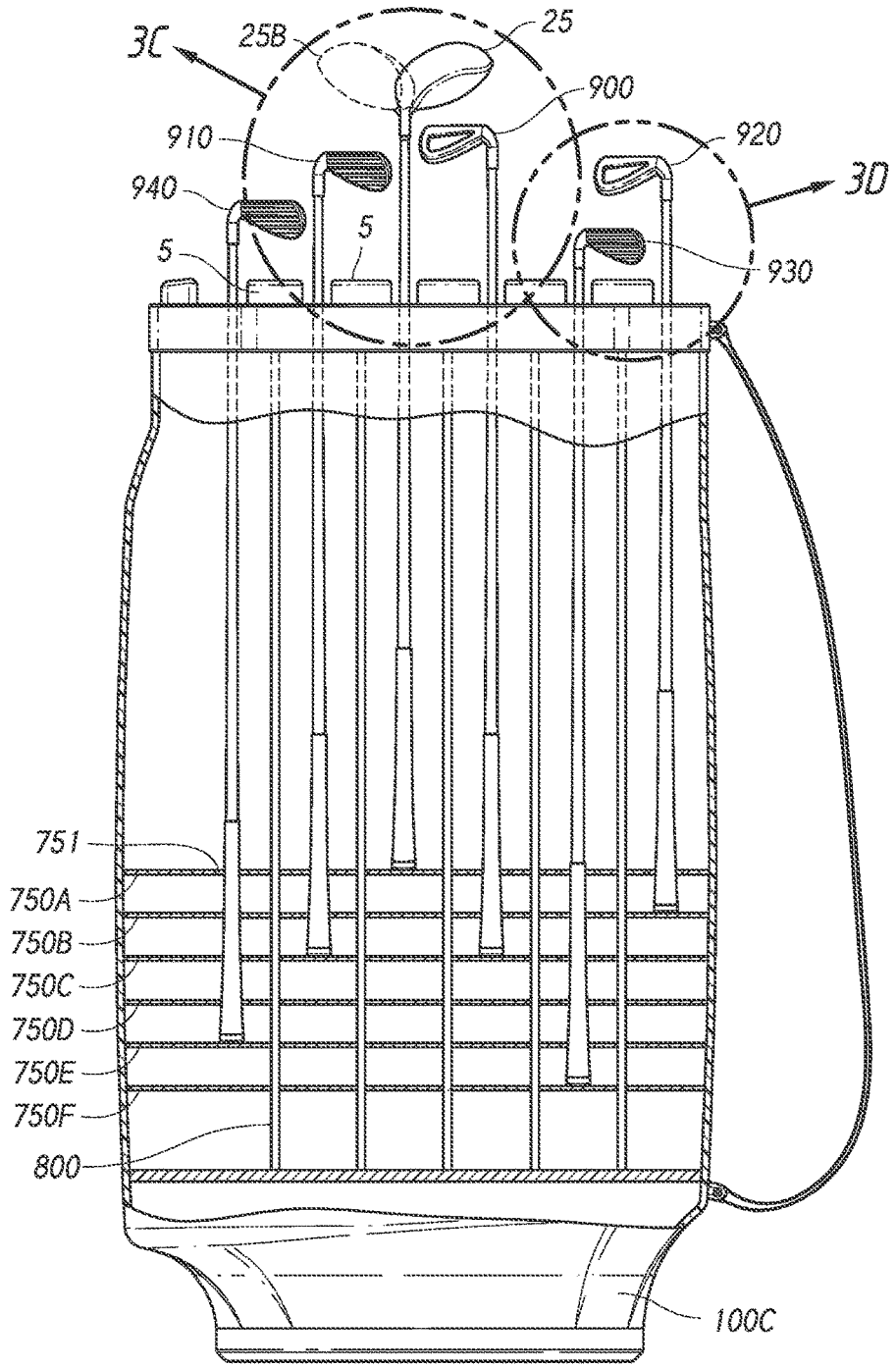
FIG. 8 is a partial sectional view of the golf bag of FIG. 1 illustrating internal features that provide multiple termination points within the different club compartments.
Figure 9:
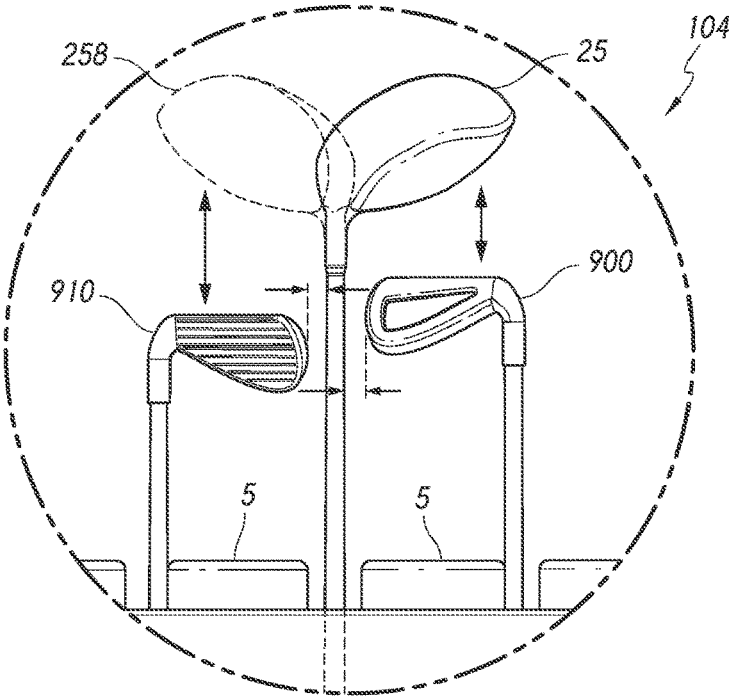
FIG. 9 is an enlarged view of clubs stored within the golf bag of FIG. 8 illustrating the spacing between the club heads and club shafts that prevents contact between clubs.
Figure 10:
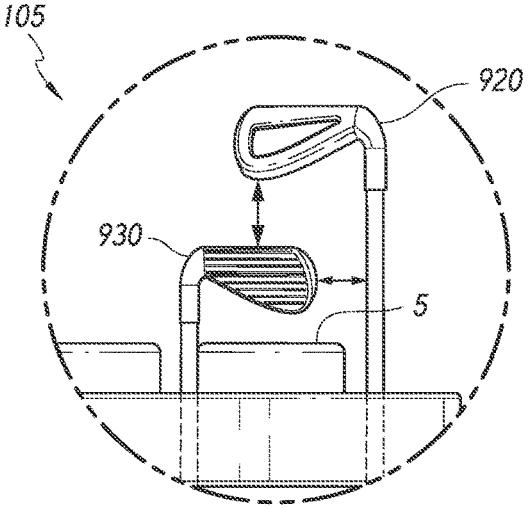
FIG. 10 is another enlarged view of clubs stored within the golf bag of FIG. 8 illustrating spacing between the clubs.

FIG. 8 is a partial cross-sectional view showing how the multiple bases forming varying terminal points for the clubs and the dual function wide separators cooperate to keep the club heads from touching each other and the club head of one club impacting the shaft of another to prevent clanking and damage to the clubs. FIGS. 9 and 10 are enlarged partial views of the top section of a first embodiment that illustrate the utilitarian function of the dual function wide separators and the progressive rack technique in keeping the clubs apart even when they move and shift positions when stored in the bag and being transported. In FIG. 9, it is illustrated that the driver is able to swivel 360 degrees while staying clear of the two surrounding clubs. In FIG. 10, it is illustrated that a club is able to shift position and face the club stored next to it in the bag while maintaining a gap between its head and the shaft of the other club next to it.

With reference to FIG. 8, an example of the interior structure of the golf bag 100, which provides for multiple terminal points, is shown. In some configurations, the interior structure being configured to provide multiple terminal points is a core feature in accomplishing the benefits that one or more of the disclosed embodiments sets out to achieve as disclosed hereinabove. Notably, such benefits include inhibiting or preventing the club head of a club from making contact with the club heads or shafts of the other surrounding clubs when stored in the bag and carried around the golf course either by a motorized or push cart, or when it is carried by a player over his shoulder, and thereby as a result reducing or eliminating club clanking and damage. However, in other arrangements, the multiple terminal points feature may be omitted while other disclosed features are used in any desired combination.

With reference to FIGS. 8-10, the club 910 is inserted in its compartment 55 and it extends downwards, going through the holes 751 in the insert bases 750A and 750B, and coming to rest at its terminal point on the insert base 750C. The dual function wide separator 5 serves as a barrier between the compartment 55 for the club 910 and the stall or compartment 55 of the club 940 and thereby prevents the club 910 from making contact with the club 940. The club 940 is also shown extending downwards and terminating at its allotted point on the insert base 750E. Similarly, the club 25 comes to rest at a terminal point on the insert base 750A, the club 900 comes to rest at a terminal point of the insert base 750C, the club 920 comes to rest at a terminal point on the insert base 750B, and the club 930 comes to rest at a terminal point on the insert base 750F. The terminal points that vary in height or position relative to a longitudinal axis of the golf bag 100 produce the progression in the club arrangements inside the bag 100. That is, the heights of the various terminal points can be staggered in such a manner to avoid locating the club heads at the same relative height, or at least the club heads of clubs that are in close proximity to one another and, thus, have a potential to contact one another. Thus, some club heads may be located at the same height, but preferably those club heads are remote from one another in the bag 100 with one or more clubs positioned therebetween.

As apparent in FIG. 8, and as illustrated in greater detail in FIGS. 9 and 10, if the clubs shift position and move to face in the direction opposite that which they appear in the figure, the dual function wide separators are configured to prevent contact in the same manner it does in the illustrated position. That is, the dual function wide separators are configured to prevent contact between clubs no matter the position of the clubs within their respective compartments 55 or the rotational position of the clubs. In some configurations, inside the bag there will be no entanglement of the shafts and the grips because each compartment 55 is closed or completely separated from top surface to or toward the base of the golf bag by a plurality of partitions 800, thus avoiding contact between clubs all the way from the top surface to the base of the golf bag when they are stored inside the bag. Such an arrangement can ease replacement of clubs into the bag 100 by preventing contact of the grip of the club being replaced with the grips of other clubs in the bag 100, which can occur in prior art bags. By design, the grips usually have good frictional properties and do not slide well against one another. The individual compartments 55 may not be entirely sealed from one another. That is, openings (e.g., vent holes or weight-reductions holes) may be present in the partitions 800, but preferably the partitions are configured to maintain each club in its designated compartment 55 from the top of the bag 100 to the bottom of the bag 100.

As illustrated, in some configurations, a plurality of insert bases are provided for creating terminal points of different heights (relative to the vertical or longitudinal axis of the bag 100) on which the grip end of the clubs come to rest in the bag 100. For instance, the driver 25 is resting on its base 750A, while the 9 iron 930 rests on a lower base 750F. It becomes apparent, therefore, that the view of the club heads sticking out in the top surface of the golf bag 100 as shown, is the product of the multiple and varying terminal points, which in some arrangements can be defined by the insert bases which are stacked in the bag 100 to provide a plurality of optional terminal points or terminal heights, which allow a progressive arrangement of the terminal heights depending on which insert base is configured to provide the terminal point for any particular club compartment. The end result is an efficient separation of the clubs to inhibit or, preferably, prevent contact when they move or shift position in any direction when stored in their individual compartments in the bag 100 during transportation. This is made evident in the two enlarged partial views 104 and 105 of FIGS. 9 and 10 of the top section 100B of the bag. As the first enlarged view 104 illustrates, the driver 25 resting on a different terminal point stands clear of the 2 iron 910 and the 3 iron 900, which are stored next to the driver 25 and which terminate at two different and, for example, lower insert bases. As a result, the driver 25 can shift position right to left, vice versa, or swivel 360 degrees without its head making contact with the heads of the 2 iron 910 and the 3 iron 900. Similarly, if the 2 iron 910 and the 3 iron 900 shift in similar situation, the different heights of the club heads as a result of the different terminal points (taking into account differences in club length) in combination with the dual function wide separators inhibit or prevent the clubs 900, 910 from contacting the driver 25.

In the second enlarged view 105, the 9 iron 930 shifts position and now is facing the club 920, but as a result of the varying terminal points 750F and 750B and the dual function wide separator demarcating their individual stalls 55, the head of the 9 iron 930 and that of the club 920 stay clear of each other. In addition, the head of the 9 iron 930 stays clear from touching the shaft of the club 920. This prevents the club from clustering and thus producing the unpleasant clanking sound, a deficiency to which prior art golf bags are prone.

Figure 11:
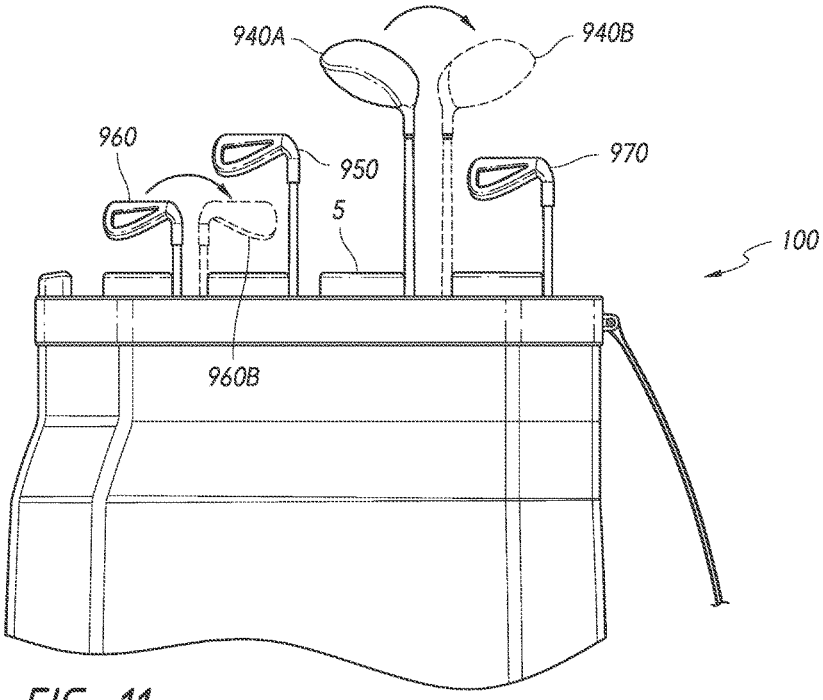
FIG. 11 is a side view of a portion of the golf bag of FIG. 8 illustrating that contact is prevented even when the clubs move to different positions within the club compartment.

FIG. 11 is side view of the golf bag 100 depicting the role of the dual function wide separators 5 in conjunction with the progressive rack technique system (FIG. 8) to keep the clubs constantly apart when they are stored in the bag 100 and when they shift positions within the bag 100 during transportation. As shown in FIG. 11, a club 940 has shifted from its original position (solid line) from left to right and in a second position 940B (dashed line) is facing a club 970 in the bag 100. The progressive rack technique system helps elevate the club 940 and brings its head clear above that of the club 970 situated below, thus preventing the two club heads from banging into each other, while the dual function wide separator 5 keeps the head of the club 970 from making contact with the shaft of the club 940. A similar situation is apparent in the relationship and the dynamics between the club 960 and the club 950, and between club 950 and club 940.

Figure 12:
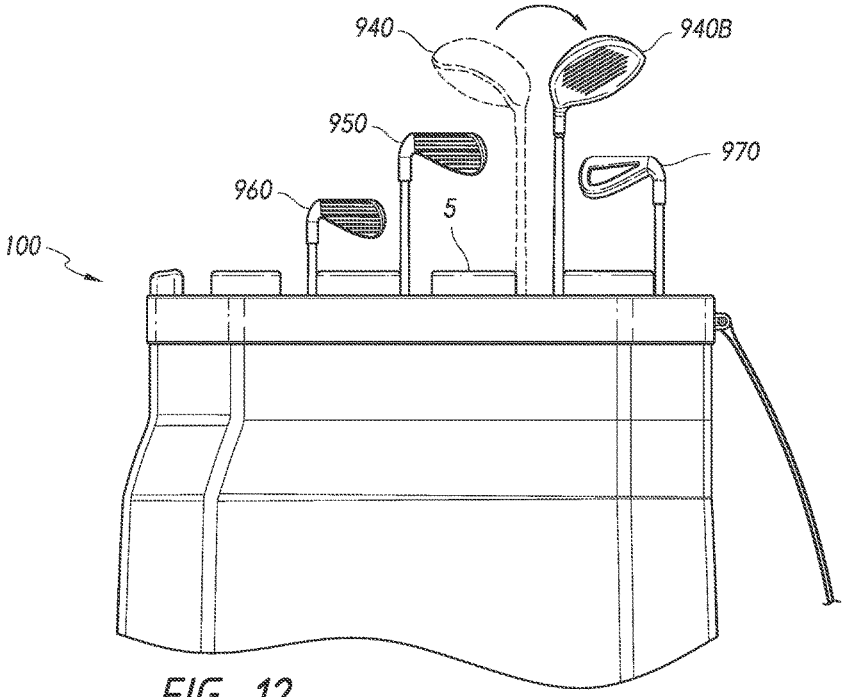
FIG. 12 is a side view of the golf bag similar to FIG. 11 with the clubs in different positions.

FIG. 12 illustrates the bag 100 of FIG. 11 with the clubs in different positions in FIG. 12 relative to FIG. 11. In FIG. 12, the position of the club 940 seen in FIG. 11 has shifted to the right (940B), while the both the club 960 and the club 950 have now moved and are facing in a new direction. As apparent, the heads of the clubs are prevented from bumping into each other and the heads of the lower clubs equally are prevented from hitting the shaft of the taller clubs stored in the next compartment. Preferably, this includes prevention of hitting when the clubs move in complete 360 degrees. To achieve such an efficient result, the illustrated bag 100 utilizes the measurement system where the width of the separators is equal to or greater than the normal length of a club head when measured from its heel to its toe. In some configurations, this length is approximately 3-5 inches, with most irons being between about 3.3-3.7 inches or about 3.5 inches. Putters can be between about 4-5 inches or about 4.4 or 4.5 inches. A driver can be about 5 inches and other woods about 4 inches. This, in turn, corresponds to the gap—toe to toe, toe to shaft—between two clubs placed next to each other in the bag. At least some of the illustrated embodiments, therefore, provide protection with the dual function wide separators being sized by virtue of the intended club-head size/separator width ratio. The height of a club head can be between about 2-5 inches, with irons typically being between about 2-2.5 inches and woods being larger, such as about 2.5-5 inches. This height, along with the lengths of the clubs, can be considered in determining the thickness or separation of the insert bases 750/760. The lengths of the clubs can vary between about 36-46 inches, for example, with the irons being on the lower end of the range and the woods being on the higher end of the range.

Figure 13:
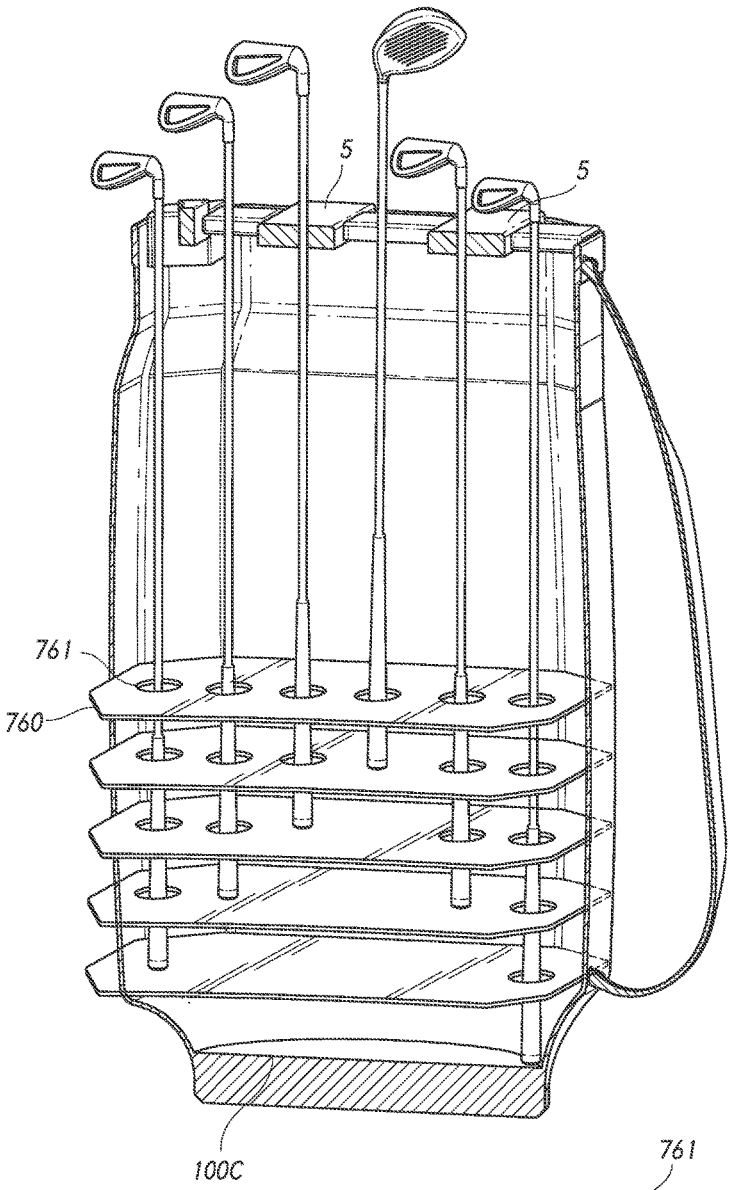
FIG. 13 is a partial sectional view of a golf bag illustrating internal insert base features that provide multiple termination points within the different club compartments.

FIG. 13 is a cross-sectional view of a first embodiment of a golf bag having golf clubs stored in their respective compartments and descending downwards into the bag, their grips terminating and coming to rest at varying points on the insert bases in the bag by a progressive technique. The dual function wide separators working in conjunction with the progressive rack technique to achieve the efficient result of keeping the clubs from making contact with each other, as shown, during transportation and thus reducing or eliminating clanking noise and club damage. This view also shows multiple insert bases, including holes in them to allow club shafts to pass through, arranged in racks or stacks. The holes have been enlarged for illustration purposes. The depiction does not constitute actual size. The full length separators are not shown for clarity.

With continued reference to FIG. 13, the golf bag 100 comprises multiple insert bases 760 in a stacked arrangement one above the other. Each insert base has one or more holes 761 to let clubs pass through the insert base 760. The insert bases 760 extend horizontally from one side of the interior of the bag 100 to the other and from a front side to a rear side. In other words, in some configurations, the insert bases 760 can be co-extensive with an interior of the bag 100 in a plane that is perpendicular to a vertical or longitudinal axis of the bag 100. As described above, the insert bases 760 provide multiple and varying terminal points for the clubs and thus create the progressive manner in which the clubs come to rest inside the bag. This progressive rack technique in turn influences the way the club heads appear or are positioned on the top section of the bag as shown. It is apparent that the club heads stand clear of each other (or at least neighboring clubs) and thus contact between them is prevented. The dual function wide separators 5 then keeps the club heads of lower placed clubs from touching the shaft of the club above them. In so doing, the golf bag remedies the clustering and the unpleasant clanking noise associated with prior art golf bags.

Figure 14:
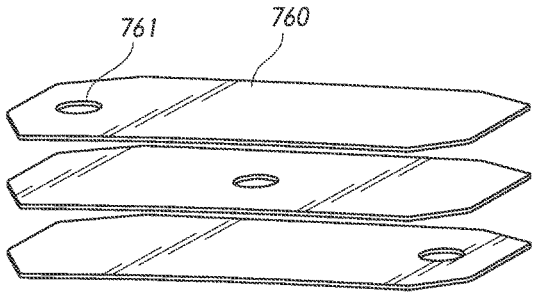
FIG. 14 illustrates several insert bases separate from the golf bag.

FIG. 14 is a stand-alone view of several insert bases 760 with hole or holes 761 embodying the progressive rack technique. The size of the inserts 760 and holes 761 and the quantity depicted in the drawing are for illustration purposes and do not represent actual size or the definitive quantity inserted in the golf bag.

The insert bases 760 can fill the interior of the golf bag 100 in width and depth directions and can have a thickness or separation selected to provide the desired vertical offset between clubs. In some configurations, the thickness or separation is approximately equal to, somewhat less or somewhat greater than the height of the heads of the club(s) that are intended to rest on or pass through the insert base 760. That is, the thickness or separation of the insert base 760 (along with consideration of length differences between the clubs) will determine the offset between a club that rests on the top surface of the insert base 760 and a club that passes through the opening 761 in the insert base 760 and rests immediately below the insert base 760 (either on the bottom of the bag 100 or on the next lower insert base 760). Thus, the thickness or separation of the insert base 760 can be selected accordingly.

Furthermore, the thicknesses or separations of the insert bases 760 within a single golf bag 100 can vary relative to one another depending on the club head height(s) and the club lengths of the various clubs desired to be accommodated within the interior of the golf bag 100. Instead of individual insert bases 760 that are stacked within the golf bag 100 in a modular fashion, a single (integrated or unitary) structure can be used to create the several desired terminal points for a portion or all of the clubs that are intended to be accommodated within the bag 100. Such a structure can also include the partitions between the individual club compartments within the bag 100 and, in some cases, the dual function wide separators. In addition, other suitable arrangements can be utilized to create the desired terminal points, partitions and separators within the bag 100. For example, the partitions and separators can be constructed as a single (integrated or unitary) structure. Individual insert bases can be provided for each club cavity created by the partitions. The individual insert bases can have a thickness or separation (a vertical or height dimension relative to the bag 100) selected to position the club head of the relevant club as desired, taking into consideration the position of the neighboring clubs to achieve the offset of the heads of neighboring clubs.

CONCLUSION

It should be emphasized that many variations and modifications may be made to the herein-described embodiments, the elements of which are to be understood as being among other acceptable examples. All such modifications and variations are intended to be included herein within the scope of this disclosure and protected by the following claims. Moreover, any of the steps described herein can be performed simultaneously or in an order different from the steps as ordered herein. Moreover, as should be apparent, the features and attributes of the specific embodiments disclosed herein may be combined in different ways to form additional embodiments, all of which fall within the scope of the present disclosure.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Moreover, the following terminology may have been used herein. The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" or "approximately" means that quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but should also be interpreted to also include individual values and sub-ranges within the indicated range. Thus, included in this numerical range are individual values such as 2, 3 and 4 and sub-ranges such as "about 1 to about 3," "about 2 to about 4" and "about 3 to about 5," "1 to 3," "2 to 4," "3 to 5," etc. This same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

What is claimed is:

1. A golf bag configured to eliminate contact between golf club heads, comprising:

a body including an elongated octagonal shape in a top view, a flat top surface in parallel with a flat bottom surface, and four pairs of opposing flat sides, each pair of opposing flat sides being in parallel to define an interior octagonal space;

a plurality of club openings formed through the top surface and spaced apart from each other by a distance greater than a length of a golf club head such that when golf club shafts are inserted into a respective one of the club openings the golf club heads of the shafts are disposed outside the golf bag and cannot contact a shaft of an adjacent golf club while the shafts rotate within the respective club opening; and a plurality of bases disposed one above another and extending horizontally from one side of the interior of the bag to the other and from a front side to a rear side, each of the bases having a predetermined number and sequence of holes disposed therethrough such that adjacent golf clubs extending through aligned base holes and respective club openings are maintained at different heights such that adjacent golf club heads cannot contact each other during rotation within the holes.

2. The golf bag of claim 1, further comprising:

a plurality of external club receptacles provided on one or both of elongated outer sides.

3. The golf bag of claim 2, wherein the plurality of external club receptacles includes three receptacles, wherein each of the three receptacles are disposed at different heights such that heads of gold clubs disposed therein are maintained at different heights.

4. The golf bag of claim 1, wherein the plurality of bases includes five horizontal bases fixed vertically above each other.

5. The golf bag of claim 4, wherein the first lowest base closest to the bottom surface includes one hole, the second lowest base includes two holes, the third lowest base includes four holes and the fourth lowest base includes five holes.

6. The golf bag of claim 5, wherein the fifth base disposed above the fourth base includes six holes.

7. A golf bag, comprising:

a body including an elongated octagonal shape in a top view, a flat top surface in parallel with a flat bottom surface, and an interior octagonal space including two opposing sides thereof are greater in width than six other sides;

a plurality of club openings extending through the flat top surface and being separated by spacers formed in the top surface that are greater in length than heads of golf clubs; and a plurality of bases aligned one above another and extending horizontally from one side of the interior of the bag to the other and from a front side to a rear side, the bases having holes disposed therethrough in a predetermined sequence within each base and with respect to other bases such that aligned holes of different bases form compartments to receive and maintain a plurality of golf club shafts at different heights such that when the golf club shafts are inserted through the club openings, the heads of adjacent golf clubs are disposed above the club openings and at different heights than adjacent club heads.

8. The golf bag of claim 7, wherein a center club opening and corresponding aligned base holes are configured to receive and maintain a driver club having the largest head and longest shaft such that the driver club head extends furthest outside the flat top surface.

* * * * *